United States Patent [19]

Brandli

[11] 4,395,943

[45] Aug. 2, 1983

[54] INTERPROXIMAL TOOTHBRUSH

[75] Inventor: Paul Brandli, Thalwil, Switzerland

[73] Assignee: Esro AG, Switzerland

[21] Appl. No.: 304,034

[22] Filed: Sep. 21, 1981

[30] Foreign Application Priority Data

Oct. 22, 1980 [CH] Switzerland ..... 7877/80

[51] Int. Cl.[3] ..... A46B 9/04; A46B 3/18

[52] U.S. Cl. ..... 15/167 R; 15/206

[58] Field of Search ..... 15/110, 167 R, 167 A, 15/206

[56] References Cited

U.S. PATENT DOCUMENTS

| | | | |
|---|---|---|---|
| 1,337,819 | 4/1920 | Braun | 15/206 |
| 2,972,157 | 2/1961 | Peterson | 15/206 |
| 3,124,823 | 3/1964 | Charvat | 15/206 |
| 3,163,874 | 1/1965 | Bauer | 15/167 R |
| 4,319,377 | 3/1982 | Tarrson et al. | 15/167 R |

FOREIGN PATENT DOCUMENTS

| | | | |
|---|---|---|---|
| 3285 | of 1907 | United Kingdom | 15/206 |
| 409462 | 5/1934 | United Kingdom | 15/206 |

*Primary Examiner*—Peter Feldman

*Attorney, Agent, or Firm*—McGlew and Tuttle

[57] ABSTRACT

A brush construction is disclosed which comprises one or more twisted wires having fixed filaments between turns of the wire or wires, the wire or wires having an electrically insulated, wear-resistant and elastic layer thereon. This prevents the wire from reacting with its surroundings, for example, producing a galvanic or electrical effect when used as a dental or oral cleansing brush.

2 Claims, 2 Drawing Figures

INTERPROXIMAL TOOTHBRUSH

FIELD AND BACKGROUND OF THE INVENTION

The present invention relates to a brush construction in general and, in particular, to a new and useful brush which holds its filaments or bristles between the turns of a twisted wire having an insulating soft material covering.

Brushes which consist of filaments or bristles that are clamped in between two twisted wires are well known in the cosmetic industry, for example, for applying eyelash mascara or the like. Likewise, brushes of this type are used in the cleaning of teeth, namely, in interdental spaces and between the gums and dental bridges or the like.

In the cosmetics industry, it can be observed that, in the case of rather old preparations or those that have not been used for prolonged periods, decomposition can take place or the wires of the brushes can be oxidized and the bristles are then no longer held sufficiently firmly and are caught on the eyelashes, or the preparation can be adversely affected by the material of the wire. In the cleaning of teeth, it can be observed that pain is induced, due to galvanic effects, in the case of exposed or periodontous necks of the teeth and also in the case of amalgam fillings in the teeth, because of hypersensitivity so that, for this reason, adequate cleaning is frequently not carried out. Moreover, there is the risk of injury due to the free metal ends of the wire.

SUMMARY OF THE INVENTION

It is therefore an object of the present invention to avoid these disadvantages of known brushes of the type initially mentioned.

Accordingly, an object of the present invention is to provide a brush, particularly one which is useful in the application of cosmetics or as an oral cleansing brush, which comprises at least one twisted wire having a plurality of filaments held between turns of the twisted wire, and a layer of wear-resistant, electrically insulating and soft elastic material covering the at least one wire.

Another object of the invention is to provide such material of nylon or other thermoplastic material, cross-linked material, such as polyurethane, in a layer which is applied, sintered or glued to the wires or the layer can be produced by flocking.

A still further object of the invention is to provide a brush wherein the layer is color-coated.

Another object of the invention is to provide a brush which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENTS

Figure 1:
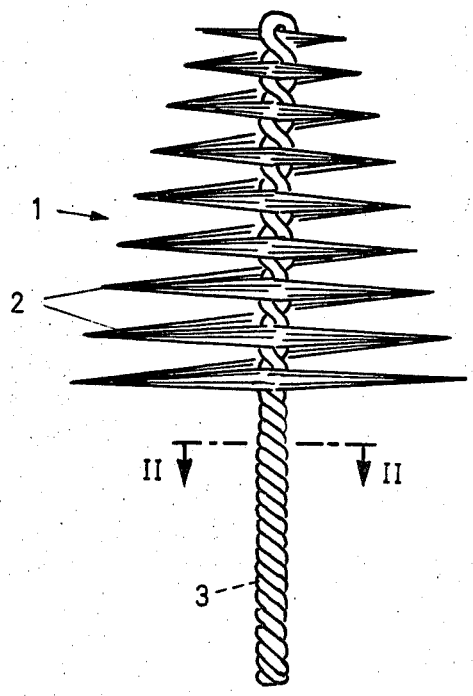
FIG. 1 shows an elevation of a brush according to the invention.
Figure 2:
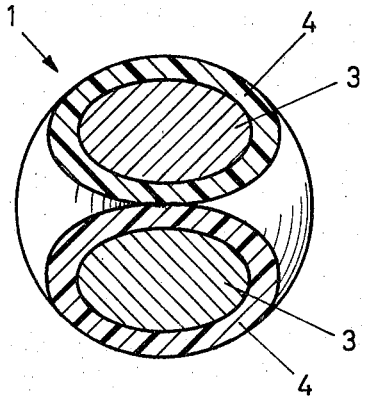
FIG. 2 shows a sectional view taken along the line II—II of FIG. 1.

The brush 1, according to the illustration in FIGS. 1 and 2, is a so-called Proxa or interproximal type toothbrush and it is used for cleaning the interdental spaces. It consists, in the customary construction, of a twisted stainless steel double wire 33 of about 0.3 mm diameter for each wire strand, and of filaments 2 inserted between the twists. The double wire 3, 3 has an outer end portion, as shown in FIG. 1, from which the filaments extend radially in all directions.

According to the invention, the steel wire 3 is enclosed by an electrically insulating layer 4. This electrically insulating layer consists of a soft elastic and abrasion-resistant material, for example, nylon or polyurethane. This layer can be applied as a lacquering by dipping or spraying, or the insulating material can be in the form of a tube drawn over the wire.

As a further embodiment, the layer can also be spun or braided, or the wire can be wound with a thread of one of the materials mentioned.

As a third possibility, given here by way of example, of producing the layer, the steel wire could also be flocked, after dipping in an adhesive composition, with fibers of one of the materials mentioned.

Such an insulation prevents the bare steel wire from being exposed to its surroundings and from causing galvanic effects on fillings and on dentine-free areas of the tooth. Moreover, the soft elastic nature of the applied layer provides a certain degree of safety against injury to both the gums and to the dentine, such as would be entirely possible with the steel wires which are now used bare.

By coloring the plastics, it would also be possible to provide a conspicuous differentiation for brushes having different properties, such as thickness or hardness of the filaments.

While a specific embodiment of the invention has been shown and described in detail to illustrate the application of the principles of the invention, it will be understood that the invention may be embodied otherwise without departing from such principles.

What is claimed is:

1. An interproximal toothbrush for cleaning the interdental spaces between teeth comprising, one twisted double wire having an outer end portion for insertion into an interdental space with a plurality of fixed filaments positioned between turns of said one twisted double wire said filaments extending radially from said outer end portion in all directions, said twisted double wire having a covering layer of wear-resistant electrically insulating and soft elastic material formed of a continuous, coherent lacquered layer of plastic, said twisted double wire comprising two wire strands each with a diameter of about 0.3 mm, said plastic being cross-linked polyurethane, each of said wire strands being entirely enclosed by said layer of plastic material.

2. A brush according to claim 1, wherein said fixed filaments increase in length from an end of said outer end portion of said one twisted double wire to form a tapered interdental brush.

* * * * *